US006569379B2

(12) United States Patent
Bates et al.

(10) Patent No.: US 6,569,379 B2
(45) Date of Patent: May 27, 2003

(54) CERAMIC CORE SPACER BLOCKS FOR HIGH TEMPERATURE PREHEAT CYCLES

(75) Inventors: Calvin Bates, Monroeville, PA (US); Daniel W. Severa, Brackenridge, PA (US); Joseph P. Harenski, Export, PA (US); Roger W. Kaufold, Pittsburgh, PA (US); Patricia A. Stewart, Pittsburgh, PA (US); Larry F. Wieserman, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/911,787

(22) Filed: Jul. 24, 2001

(65) Prior Publication Data

US 2003/0031973 A1 Feb. 13, 2003

(51) Int. Cl.[7] ..... C21B 3/00
(52) U.S. Cl. ..... 266/274; 432/253; 52/596
(58) Field of Search ..... 266/282, 274; 432/253; 52/596

(56) References Cited

U.S. PATENT DOCUMENTS

| | | | | |
|---|---|---|---|---|
| 122,908 A | * | 1/1872 | Perry | 266/282 |
| 1,879,246 A | * | 9/1932 | Hogue | 432/253 |
| 2,216,813 A | * | 10/1940 | Goldschmidt | 266/282 |
| 3,100,677 A | * | 8/1963 | Frank et al. | 432/253 |
| 3,338,016 A | * | 8/1967 | Bailey | 52/596 |
| 4,401,729 A | | 8/1983 | Claussen et al. | 428/623 |
| 2002/0104590 A1 | * | 8/2002 | Harenski et al. | 148/283 |

FOREIGN PATENT DOCUMENTS

| | | |
|---|---|---|
| JP | 60-026615 A | 2/1985 |
| JP | 3-287716 A | 12/1991 |

OTHER PUBLICATIONS

The Making, Shaping and Treating of Steel, 10$^{th}$ edition, pp 1031–1039, Dec. 1989.*

* cited by examiner

*Primary Examiner*—Scott Kastler
(74) *Attorney, Agent, or Firm*—Julie W. Meder; David W. Pearce-Smith

(57) ABSTRACT

A spacer member in a furnace including an aluminum tube containing a ceramic material. The ceramic material provides high compressive strength and the composite product resists high temperature creep.

32 Claims, 8 Drawing Sheets

CERAMIC CORE SPACER BLOCKS FOR HIGH TEMPERATURE PREHEAT CYCLES

BACKGROUND OF THE INVENTION

1. Field of the Invention

The present invention relates to spacer blocks positioned between aluminum ingots in preheat furnaces, more particularly, to spacer blocks produced from a ceramic material having resistance to high temperature heat and high compressive strength at room temperature and up to use temperatures of about 1160° F.

2. Prior Art

Heating of the aluminum ingots is a well-established practice for achieving desired properties in the ingot and to render the ingot sufficiently malleable for reduction in thermo-mechanical processes. During the preheating step, aluminum ingots are heated to temperatures below the melting point of the aluminum alloy. Preheating serves to control the metallurgical properties of the ingot, reduce cracking, and reduce the forces needed to further process the ingot. Typically, up to six ingots are stacked vertically in a preheat furnace at one time. To prevent the ingots from sticking to one another and to allow hot gases to circulate between the ingots for faster heatup and uniform exposure to the furnace atmosphere, spacer blocks are positioned between the stacked ingots to maintain a gap between the ingots.

Conventional spacer blocks are solid blocks of an aluminum alloy (which may be the same as or different from the alloy of the ingot supported thereby) sized about 1–4 inches×2–6 inches×6–24 inches and often weighing over 10 pounds. A single operator may handle 400 to 500 spacer blocks per shift. Such repeated handling of conventional spacer blocks could cause ergonomic problems for operators of preheat furnaces.

Additional drawbacks to conventional spacer blocks relate to their composition. When heated in a furnace, the metal of the ingot as well as the metal of the spacer blocks soften. In addition, oxide layers grow and volatile metals, such as magnesium and lithium, migrate to the surfaces of the spacer blocks and the ingots. The migrated metals cause the spacer blocks and the ingots to adhere to one another. Deformation and adhesion of the spacer blocks to the ingots is particularly problematic for the ingots at the bottom of the stack where the load is the greatest. When the preheat cycle is complete, a crane is used to remove an ingot from the stack and position the ingot at the beginning of a hot line rolling mill, reversing mill, or the like. An operator must remove any spacer blocks stuck to the ingot. Occasionally, the spacer block can be removed from the ingot by simple hand pressure. However, often times the spacer block is so tightly adhered to the ingot that it must be knocked off with a large hammer or an axe. Occasionally, a forklift or the like must be used to loosen the adhered spacer block from the surface of the ingot. Removing spacer blocks from a heated ingot by an operator exposes an operator to risk of injury from the equipment for handling the spacer block and the heat of the spacer block.

An additional problem with sticking of spacer blocks to ingot is the marks, which are typically left on an ingot upon removal of the spacer block. Spacer blocks often produce defects in the surface of the ingot. When an ingot having such a defect is subsequently rolled, the defect becomes a streak of a surface imperfection in the rolled product. For many applications of the rolled product, such defects are unacceptable in the marketplace.

Another drawback to the aluminum spacer blocks is the tendency of the various aluminum alloys of the blocks to creep at high temperatures. At temperatures of about 900–1140° F., spacer blocks having an initial dimension of 3 inch×3 inch×12 inch become deformed into dimensions of about 2.5 inch×3.5 inch×12.5 inch. Not all spacer blocks in a stack of ingots are always deformed similarly. Hence, in a set of spacer blocks used with a stack of ingots, the individual spacer blocks may have differing dimensions. Variable dimensions in the spacer blocks can aggravate sticking of the spacer blocks to the ingots. For example, when six spacer blocks are used for an ingot and two of the spacer blocks do not touch the ingot because they have been deformed, only four of the spacer blocks contact the ingot and support the entire load. In this situation, the load per unit area borne by the four spacer blocks contacting the ingot increases by about 33%. At such higher loads, the adhesion between the spacer blocks and the ingots is aggravated.

High temperature creep of aluminum spacer blocks is also a problem in preheat furnaces operated at higher temperatures, e.g., at or above about 1120° F. It has become common practice in those circumstances to position the spacer blocks between the ingots so that a portion of the spacer block extends out between the ingots. During the preheat cycle, the portion of the spacer block which is sandwiched between the ingots becomes flattened to a thickness of about ½ inch while the remaining portion of the spacer block which did not support the ingot retains its original width and height (3 inch×3 inch). In order to reuse those spacer blocks, which have been partially flattened, operators turn the spacer blocks around and position the unflattened portions of the spacer blocks between ingots. This results in the entire spacer block being flattened into a thickness of about ½. When the spacer block between the ingots is reduced to about ½ inch, airflow between the ingots is greatly reduced which results in uneven heating, extended cycle times, and insufficient exposure of the ingot surfaces to the furnace atmosphere.

Accordingly, a need remains for a spacer block for use in aluminum ingot preheat furnaces which is lightweight, does not stick to the ingot surfaces, and retains its shape during an ingot preheat cycle.

SUMMARY OF THE INVENTION

This need is met by the spacer member of the present invention, which may be used for supporting an aluminum alloy product subjected to a heat treatment. The spacer member includes a metal housing with a core of a ceramic material and having a surface, which is configured to support an aluminum alloy ingot in a furnace. The metal housing is preferably in the form of a metal tube, which may be an extruded tube, roll formed tube or a welded tube. The tube is capped at each end. The ceramic material contained within the metal tube is stable at high temperatures (e.g., up to about 2000° F.). The exterior of the support member of the present invention may be coated with a material to prevent sticking of the spacer member to an ingot in a preheat furnace. The spacer member of the present invention has dimensions preferably the similar to those of conventional aluminum spacer blocks, e.g. about 3 inch×3 inch×12 inch but weighs less than 10 pounds.

The spacer member of the present invention may be produced by providing a metal housing, such as a tube capped at one end, filling the housing with a ceramic material and enclosing the ceramic material within the housing by capping the other end of the tube. The housing may then be coated with a nonstick material to prevent the spacer member from sticking to an ingot in a preheat furnace.

A complete understanding of the invention will be obtained from the following description when taken in connection with the accompanying drawing figures wherein like reference characters identify like parts throughout.

DETAILED DESCRIPTION OF THE PREFERRED EMBODIMENTS

Figure 1:
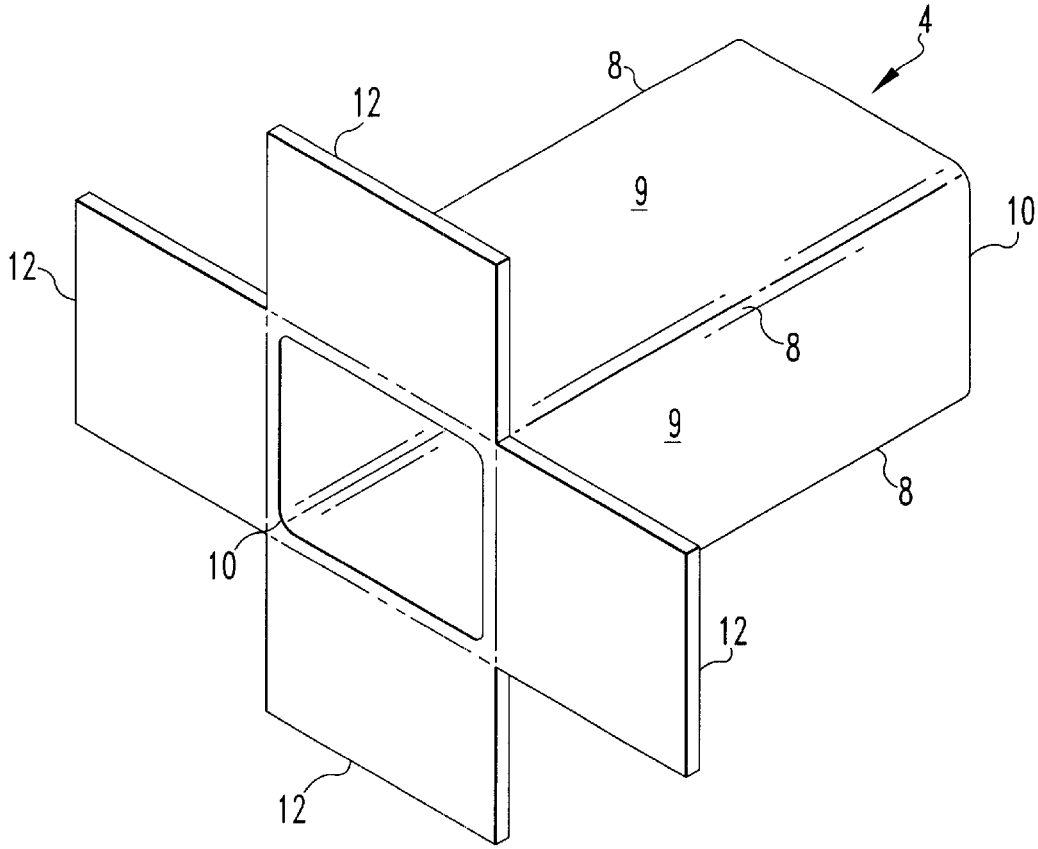
FIG. 1 is a perspective view of a housing of the spacer member of the present invention with an open end.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 4:
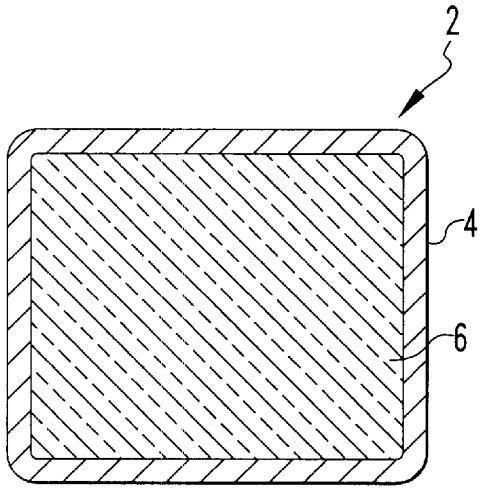
FIG. 4 is a cross-sectional view of the housing shown in FIG. 3 taken along line 4—4 filled with a ceramic material.

The spacer member 2 of the present invention includes a housing 4 (shown in FIGS. 1–3) with core 6 of a ceramic material (shown in FIG. 4). The housing 4 is preferably in the form of a tube having a generally rectangular or square cross-sectional configuration. Preferably, the spacer member is about 0.5 to about 4 inches thick. Spacer members less than about 0.5 inch thick do not allow for adequate circulation of the furnace atmosphere between ingots, and spacer members sized larger than about 4 inches thick result in an ingot stack that is too tall for conventional preheat furnaces and may destabilize the ingot stack. A preferred embodiment of the housing 4 has a square cross-sectional configuration and dimensions of about 3 inch×3 inch×12 inch. Another suitable embodiment of the housing has a rectangular cross-sectional configuration and dimensions of about 2 inch×5 inches×16 inches. Each of these preferred embodiments is sized and configured to conform with the conventional spacer blocks presently used in the ingot processing industry, however, other cross-sectional configurations of the housing 4 are encompassed by the present invention. Housing The housing 4 may be formed from an aluminum alloy, steel, a nickel alloy, a cobalt alloy, or a titanium alloy. Aluminum alloys are preferred because they have lower densities making the housing 4 relatively lightweight. In general, aluminum alloys with a solid us temperature of over about 11 80° F. are preferred. Such alloys include Aluminum Association alloys 7072, 3105, 3003, 1350, 1145, 1060, 1050, and 1199. In some very high temperature furnaces, even these aluminum alloys tend to soften. Therefore, steel and alloys of nickel, cobalt or titanium may be more suitable for the housing 4 of a spacer member used in a high temperature furnace.

The housing 4 may be formed by extruding the metal into a tube of the desired shape or by providing a metal sheet, shaping the sheet into the desired configuration, and welding the edges of the sheet together to form a tube. Preferably, the edges 8 of the housing 4 are rounded. The radius of curvature of the rounded edges 8 preferably is about 1/16 inch to about ½ inch. By rounding the edges 8, the load of ingots applied to the housing 4 is partially shifted away from the edges 8 to reduce stress at the edges 8 which could otherwise lead to failure of the housing 4 or sticking of ingots.

The exterior surfaces 9 of the housing 4 are preferably smooth to minimize mechanical interlocking with ingot surfaces during a heat treatment. A suitable maximum roughness is an Ra of about 10,000 micro inches, e.g. an Ra of about 10 to about 10,000 microinches. The smoothness of the exterior surfaces 9 may be controlled by the extrusion process or rolling process used to manufacture the housing 4, or the surfaces may be machined or polished as needed.

The exterior surfaces 9 of the housing 4 also may be coated with a material to prevent sticking to an ingot in a preheat furnace. Suitable coating materials include nickel, or alloys thereof, molybdenum or alloys thereof, boron compounds (such as boron nitride, titanium diboride and titanium boronitride), molybdenum compounds and combinations (such as electroless nickel with boronitride). Other potentially suitable coating materials may include carbonaceous materials, fluorine compounds, magnesium compounds, alumina compositions and silica compositions. The coating materials may be applied to the housing prior to forming the housing or after the housing is manufactured via conventional coating techniques, such as brushing, plasma spraying, thermal spraying, cold spraying, electroplating, electroless plating, cladding, plasma vapor deposition, sputtering, and electron beam evaporation.

While only two opposing exterior surfaces 9 need to be smoothed and/or coated as described above when used to support ingots in a preheat furnace, it is preferred that all of the exterior surfaces 9 are similarly treated. In this manner, a user need not be concerned which of the exterior surfaces 9 contact an ingot in a preheat furnace.

The core 6 is preferably manufactured from a curable ceramic material. Ceramic materials typically have a relatively low density (compared to aluminum) and high strength. Most ceramic materials are brittle and tend to crumble under impact loads; hence, the spacer member 2 includes the housing 4 to retain the ceramic core 6 in the nature of a low strength shell. The housing 4 serves to prevent the ceramic material from contacting and damaging ingots during use. Accordingly, the ends 10 of the housing 4 should be closed off to prevent escape of the ceramic core 6 during use.

Figure 2:
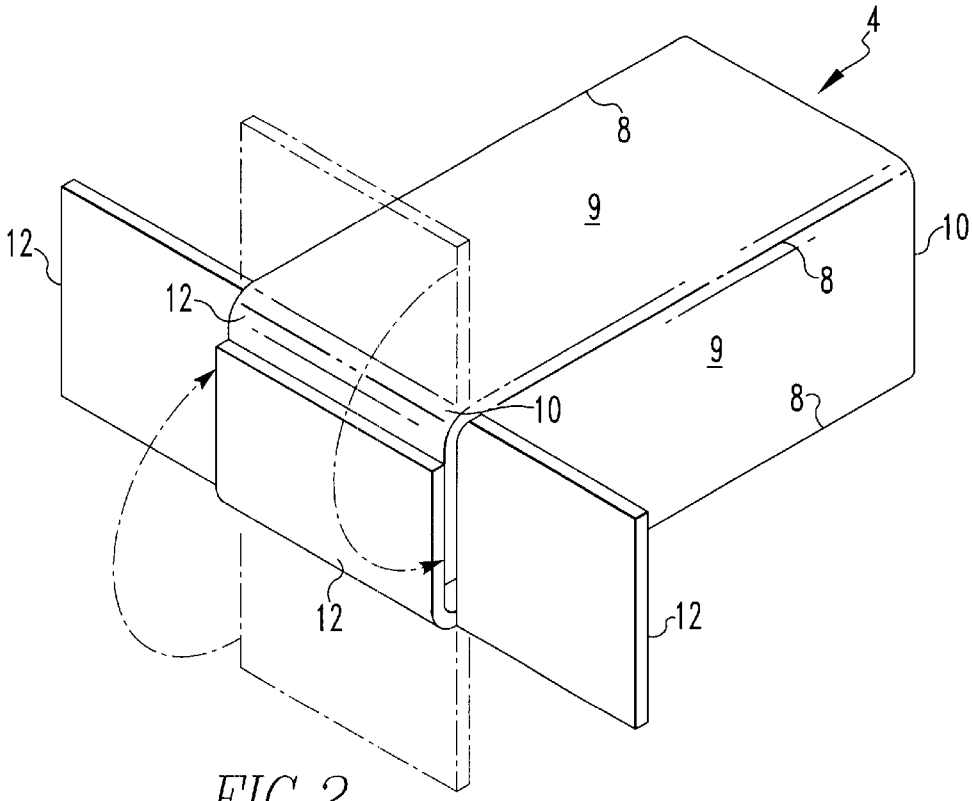
FIG. 2 is a perspective view of the housing shown in FIG. 1 with a partially closed end.
Figure 3:
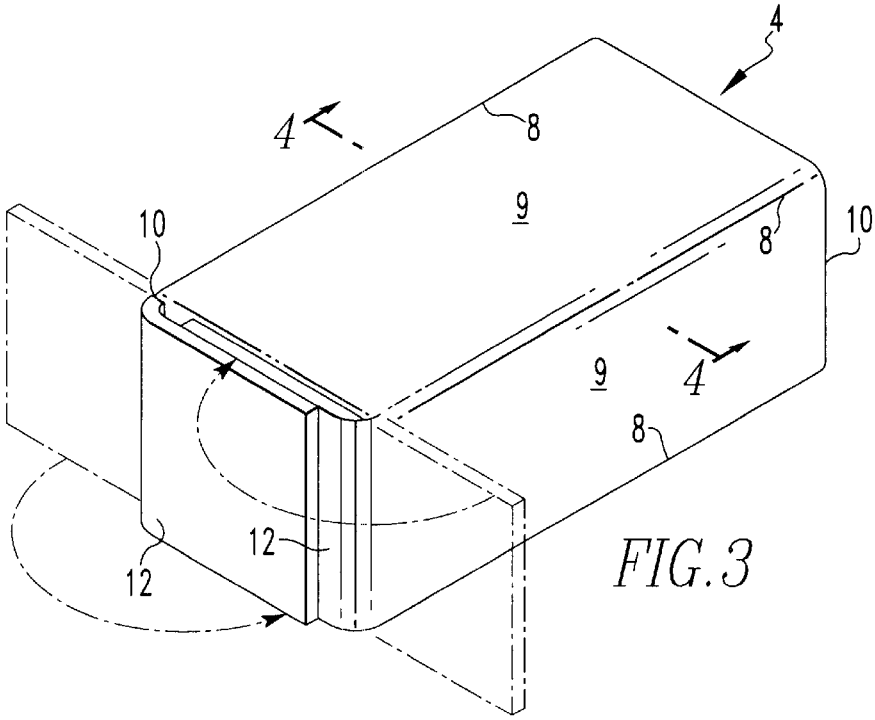
FIG. 3 is a perspective view of the housing shown in FIG. 2 with the end closed.

Ends 10 of the housing 4 may be closed off to retain the core 6 as shown in FIGS. 1–3. Each of the ends 10 of the housing 4 includes four integrally formed flaps 12. The flaps 12 may be made by forming the housing 4 and slitting the edges 8 of the housing 4 to a desired distance to create the flaps 12. As shown in FIG. 2, two opposing flaps 12 are folded onto each other and, in FIG. 3, the other opposing flaps 12 are folded onto each other. The flaps 12 preferably are fixed together such as by welding to prevent them from unfolding and releasing the ceramic material of the core 6 during use. The flaps 12 may be sized to extend nearly across the width of the housing 4 when folded over each other to ensure that the ends 10 of the housing 4 are closed off.

Figure 5:
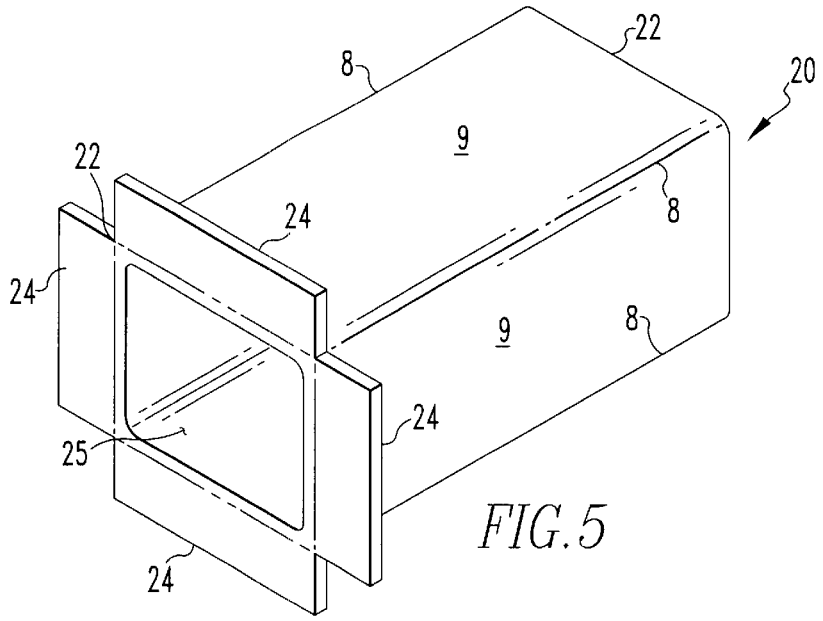
FIG. 5 is a perspective view of another embodiment of a housing of the spacer member of the present invention with an open end.
Figure 6:
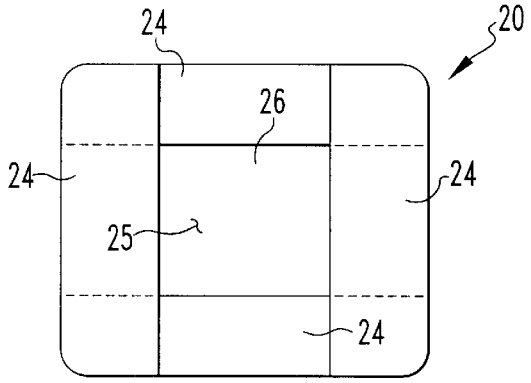
FIG. 6 is an elevation view of the end of the housing shown in FIG. 5 closed off with an end plate.
Figure 7:
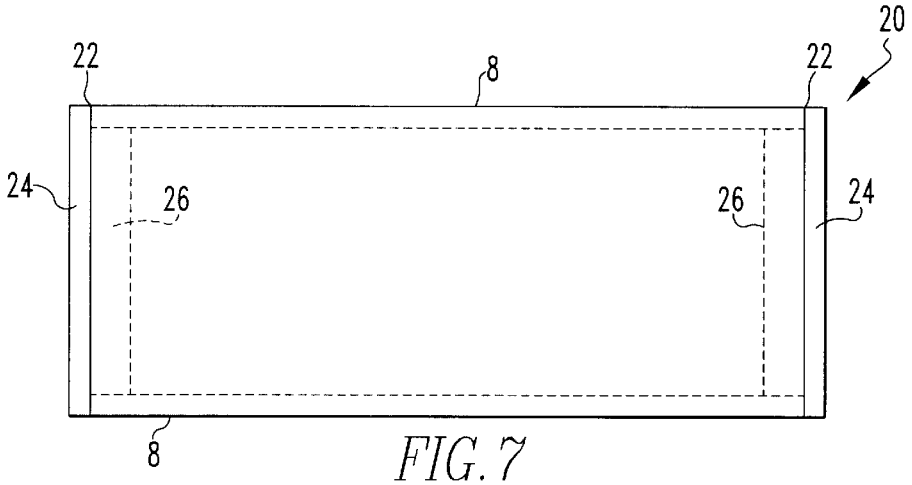
FIG. 7 is an elevation view of the side of the housing shown in FIG. 5 closed off with an end plate.

In an alternative embodiment shown in FIGS. 5–7, a housing 20 has ends 22 with flaps 24 with smaller dimensions than the flaps 12. In use as shown in FIG. 6, the flaps 24 are folded onto each other to define an opening 25 at each end 22 of the housing 20. End plates 26 are fitted within the housing 20 and positioned adjacent to the flaps 24 to close off the opening 25. The end plates 26 are preferably sized and configured to be slidably fitted within the interior of the housing 20. The flaps 24 are preferably fixed to each other and to the end plates 26 via welding.

Figure 8:
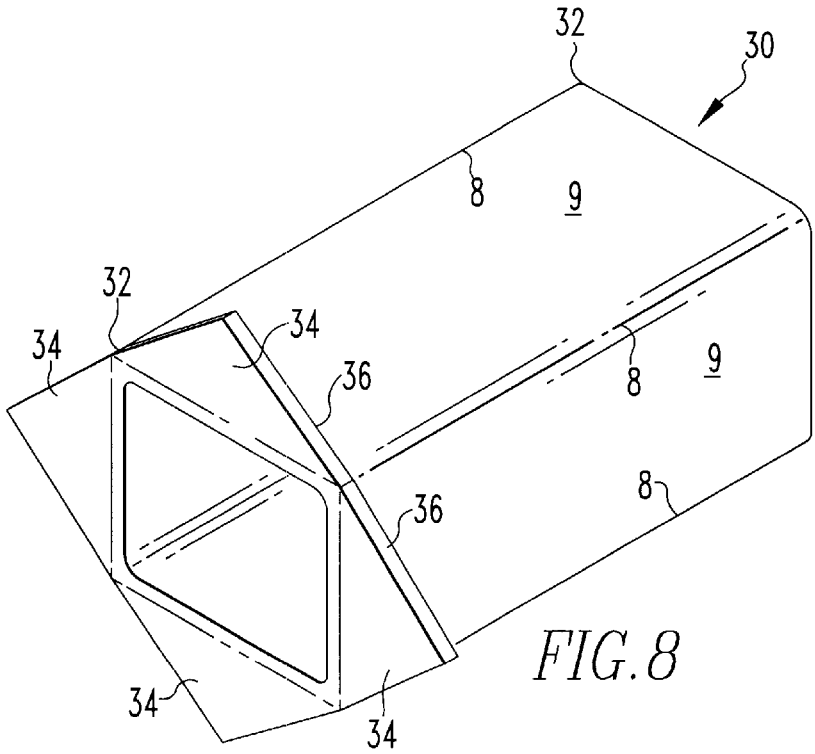
FIG. 8 is a perspective view of another embodiment of a housing of the spacer member of the present invention with an open end.
Figure 9:
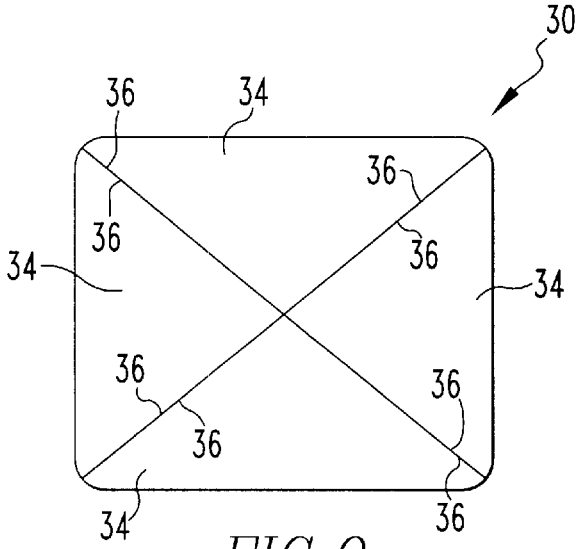
FIG. 9 is an elevation view of the end of the housing shown in FIG. 8 with the end closed.

Another mechanism for enclosing a housing 30 is shown in FIGS. 8 and 9 wherein ends 32 include triangular-shaped flaps 34 with edges 36. In use, the flaps 34 are folded towards each other so that edges 36 abut each other and may be welded together.

Figure 10:
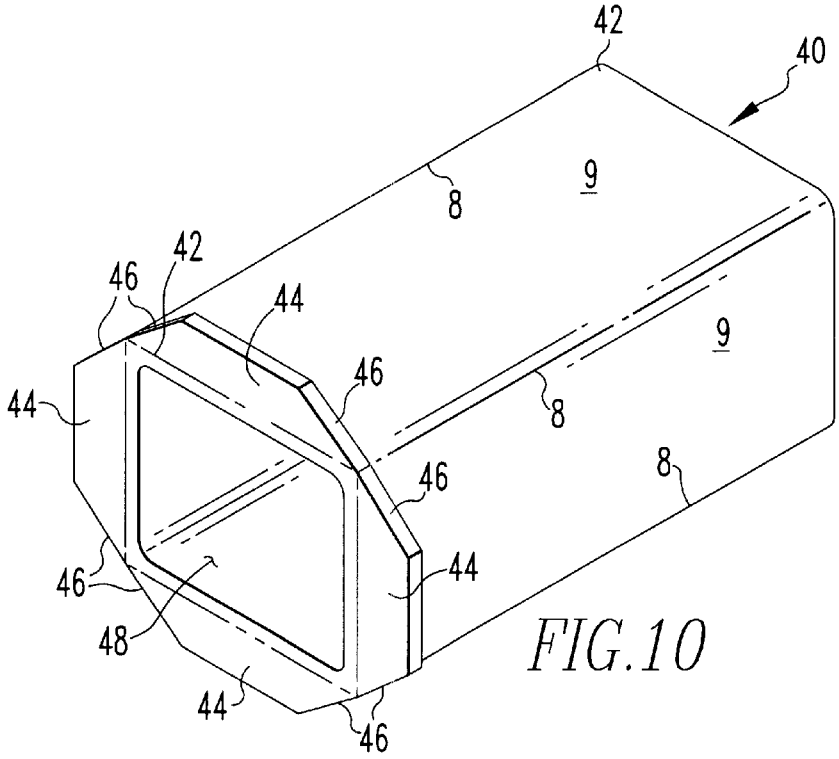
FIG. 10 is a perspective view of another embodiment of a housing of the spacer member of the present invention with an open end.
Figure 11:
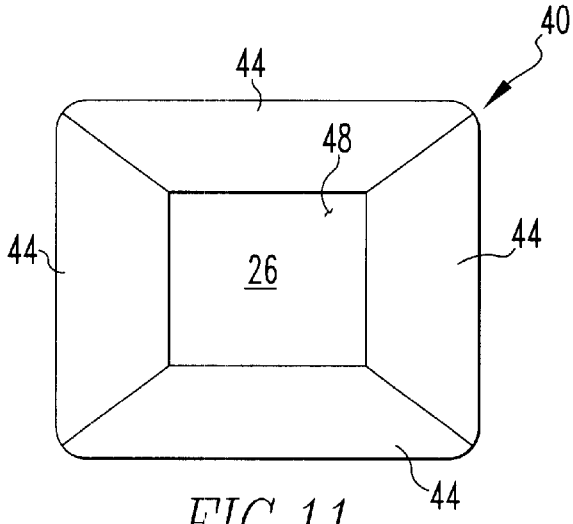
FIG. 11 is an elevation view of the end of the housing shown in FIG. 10 closed off with an end plate.
Figure 12:
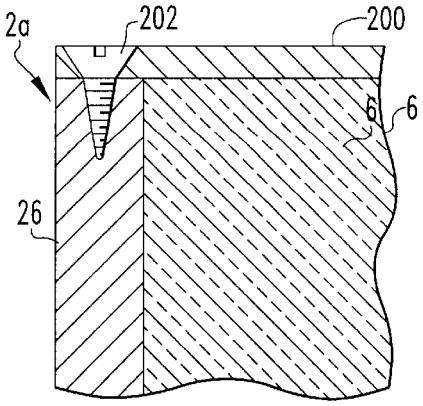
FIG. 12 is a cross-sectional view of a corner of another embodiment of the spacer member of the present invention.
Figure 13:
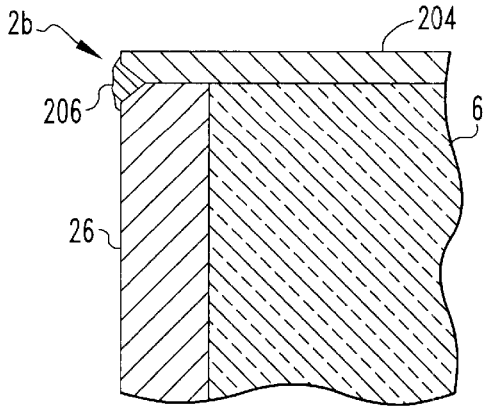
FIG. 13 is a cross-sectional view of a comer of another embodiment of the spacer member of the present invention.
Figure 14:
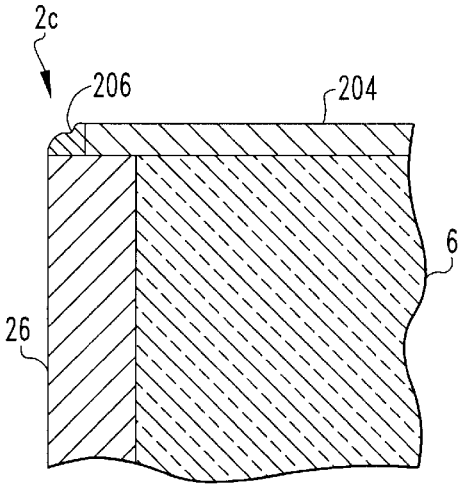
FIG. 14 is a cross-sectional view of a corner of another embodiment of the spacer member of the present invention.
Figure 15:
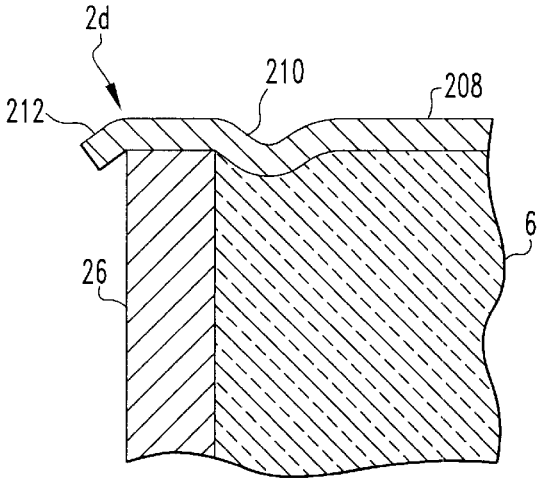
FIG. 15 is a cross-sectional view of a corner of another embodiment of the spacer member of the present invention.

Referring to FIGS. 10 and 11, another housing 40 includes ends 42 with trapezoid-shaped flaps 44 having edges 46 which abut each other when folded towards each other thereby defining openings 48. Ends plate 26 are positioned against the flaps 44 and are preferably welded thereto to close off the openings 48.

Figure 16:
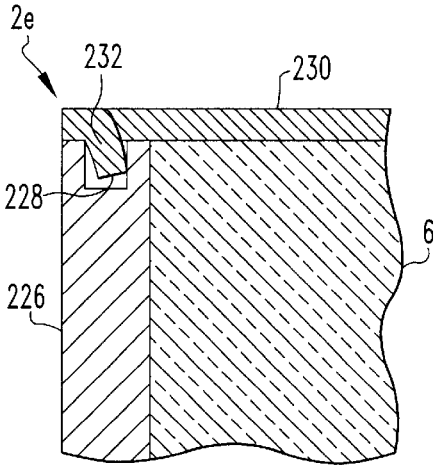
FIG. 16 is a cross-sectional view of a corner of another embodiment of the spacer member of the present invention.
Figure 17:
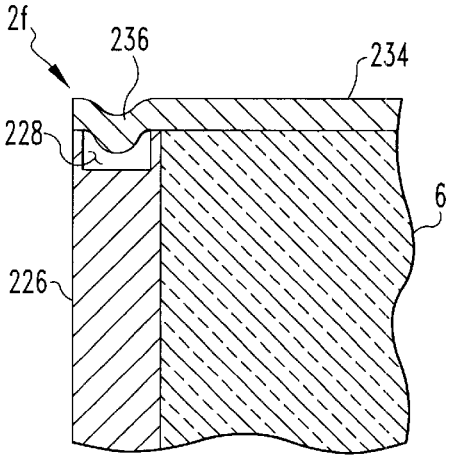
FIG. 17 is a cross-sectional view of a corner of another embodiment of the spacer member of the present invention.

FIGS. 12–17 show a portion of spacer members 2*a*–2*f* including housings without flaps. Spacer member 2*a* (FIG. 12) includes end plate 26 with one surface thereof positioned even with an end of a housing 200 and fixed thereto via a fastener 202. In spacer member 2*b* (FIG. 13), housing 204 is fixed to the end plate 26 via a welding bead 206. The end plate 26 may partially extend out of the housing 204 as shown in the spacer member 2*c* of FIG. 14 and be fixed thereto via welding bead 206. In spacer member 2*d* (FIG. 15), the end plate 26 is fully received within a housing 208. The housing 208 is bent or crimped around opposing sides of the end plate 26 at 210 and 212 to retain the end plate 26 in position. Alternatively, as shown in FIGS. 16 and 17, an end plate 226 may define a depression 228. Spacer member 2*e* (FIG. 16) includes a housing 230 having an integrally formed tab 232 that extends into the depression 228. Spacer member 2*f* (FIG. 17) includes a portion of a housing 234 deformed at 236 into the depression 228.

Hereinafter, all references to the spacer member 2 are meant to include and are equally applicable to the spacer members 2*a*–2*g* and references to the housing 4 are meant to include and are equally applicable to the housings 20, 30, 40, 200, 204, 208, 230 and 234 and; references only to spacer member 2 and housing 4 hereinafter is made for convenience. The wall thickness of the housing 4 is preferably about 1/16 inch. While thicker walls may be employed, the weight savings associated with the spacer member of the present invention are best realized using a housing 4 with a minimum wall thickness. Thinner metal walls allow for maximum amount of the ceramic material in the spacer member 2 (maximum dimensions of the core 6) and, consequently, lower weight for the spacer member 2. If the walls are too thin (e.g., less than about 1/16 inch), the spacer member may be prone to crushing and tearing under load from the ingots.

Core

The core 6 retained within the housing 4 preferably includes a curable ceramic material, which is stable at high temperatures, namely, up to about 2000° F. Suitable ceramic materials are calcium aluminates (such as CA, $C_{12}A_7$, and $CA_2$, where C represents CaO and A represents $Al_2O_3$), aluminum silicates, magnesium silicates, silica, high alumina cements (HACs), low cement castables (LCCs), silica fume low-cement castables, ultralow-cement castables (ULCCs), cement-free castables, alumina-magnesia spinel, basic low-cement castables, gel-bond castables and plastic refractories. Calcium aluminates are commercially available as Express 30 GT, Versaflow 45C Adtech, Green Lite 45L, Kast-O-Lite 26, or Green Lite Express 24 from RHI Refractories of Pittsburgh, Pa. In use, one end of the housing 4 is closed off as described above. The uncured ceramic material is poured into the housing 4 and allowed to cure. The other end of the housing 4 is then closed off. In this manner, the housing 4 acts as a shell surrounding the ceramic core 6.

The ceramic material preferably has a cold crushing strength of about twice the maximum load applied by ingots of at least about 2000 psi, preferably at least about 3000 psi. The density of the ceramic material preferably is less than the density of conventional solid aluminum spacer blocks (about 175 lbs/ft$^3$) to achieve significant weight savings for the spacer member of the present invention. Preferably, the density of the ceramic material is not greater than about 150 lbs/ft$^3$. The properties of the ceramic material of cold crushing strength and density are balanced to obtain a suitable material for the core 6. Particularly, preferred materials having a cold crushing strength of over about 3000 psi (e.g., about 3000 to about 5500 psi) and a maximum density of about 125 lbs/ft$^3$ (e.g., about 100 to about 125 lbs/ft$^3$).

Strengthening Members

In certain applications it is desirable to increase the yield strength and toughness of the ceramic material by including therein a plurality of strengthening members such as metal fibers. The metal fibers are preferably stainless steel fibers about ¾ inch to about ⅛ inch long and about ⅛ inch in diameter. A suitable concentration of metal fibers in the ceramic core 6 is about 6 wt. %. Similar increases in yield strength can be achieved by using graphite or other ceramic particles such as alumina, silica, titania, or zirconia in place of the metal fibers.

The metal fibers may further include a surface treatment to control the adhesion between the metal and the ceramic material. Examples of surface treatments include acids, bases, alcohols, carboxylic acids, phosphonic acids, silanes, and polymeric materials.

Figure 18:
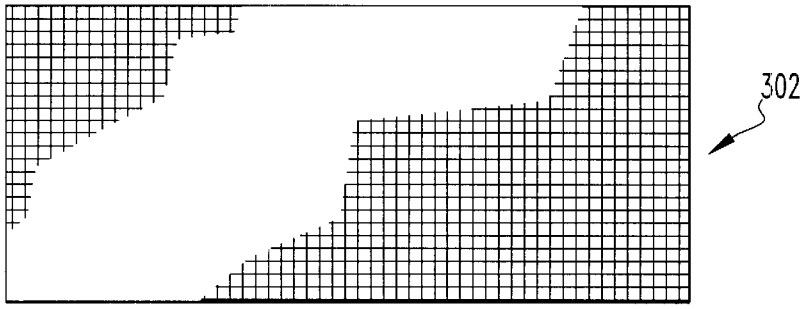
FIG. 18 is a plan view of a strengthening member of the present invention.
Figure 19:
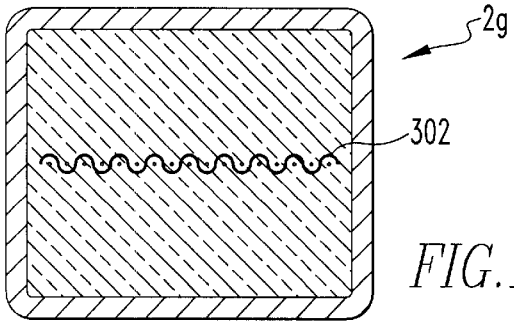
FIG. 19 is a cross-sectional view of the spacer member shown in FIG. 4 taken along line 4—4 including the strengthening member shown in FIG. 18.
Figure 20:
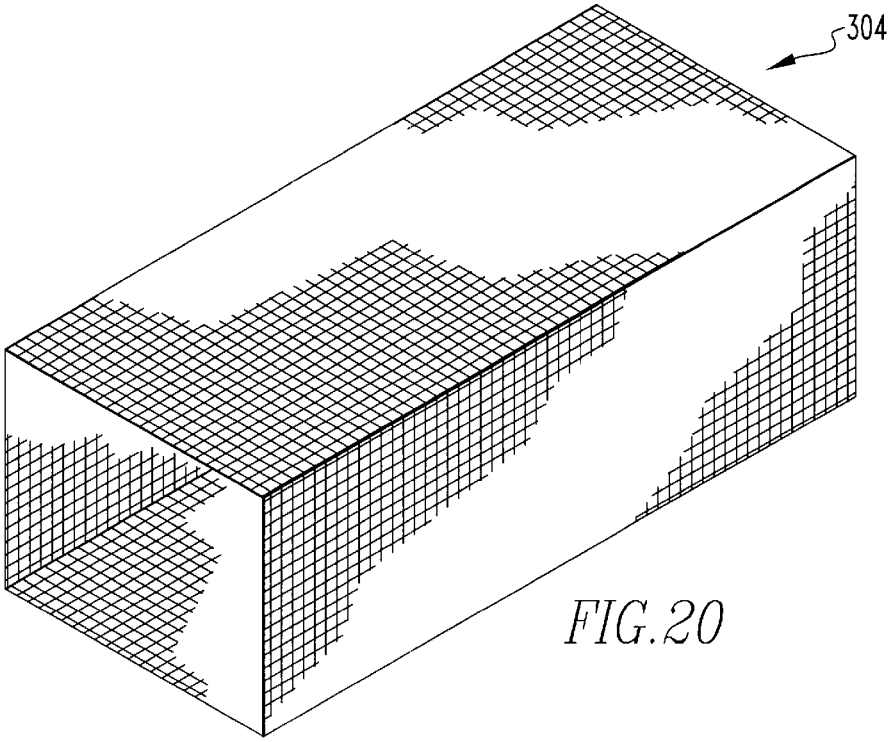
FIG. 20 is a perspective view of another embodiment of the strengthening member of the present invention.

For other applications, such as in furnaces wherein spacer members are positioned only at the ends of the ingots, the spacer members are subjected to significant bending forces. Hence, increased resistance to bending of the spacer member is desired. Increased bending resistance is provided in a spacer member 2*g* shown in FIG. 19 via a strengthening member 302 (FIGS. 18 and 19) or 304 (FIG. 20) positioned within the core 6. The strengthening member 302 includes a planar body such as a sheet of wire mesh, which is placed within the ceramic material, preferably in the plane of a centerline of the housing 4. The strengthening member 302 is preferably sized to fit within the housing 4 with a minimum distance between the edges of the strengthening member 302 and the tube walls. While the strengthening member 302 provides bending resistance in one direction (orthogonal to the plane of the strengthening member 302), the strengthening member 304 provides resistance to bending in multiple directions. Strengthening member 304 preferably is in the shape of a tube having a cross-sectional configuration similar to that of the housing 4 (e.g., rectangular or square) and also is sized to fit within the housing 4 with a minimum distance between the edges of the strengthening member 304 and the walls of the housing 4. Preferably, the strengthening member 302 or 304 is placed in the ceramic core 6 while the ceramic material cures so that the strengthening member 302 or 304 becomes fixed in place within the housing 4 by the cured ceramic material. The wire mesh of the strengthening members 302 and 304 is shown as defining square-shaped openings therethrough. This is not meant to limiting as other configurations for the openings may be used. Openings through the strengthening member 302 and 304 allow for the ceramic material to flow therethrough.

It has been found that the dimensions of the spacer member of the present invention when used to support an ingot in a preheat furnace do not change. Accordingly, the spacer member may be reused multiple times (at least 10 times) without replacement. In addition, the spacer member of the present invention weighs about 15 to about 50 percent less than conventional aluminum spacer blocks. The low weight of the spacer member provides significant ergonomic advantages in the repeated motions of replacing spacer members by operators of preheat furnaces.

Although the invention has been described generally above, the particular examples give additional illustration of the product and process steps typical of the present invention.

EXAMPLE 1

Figure 21:
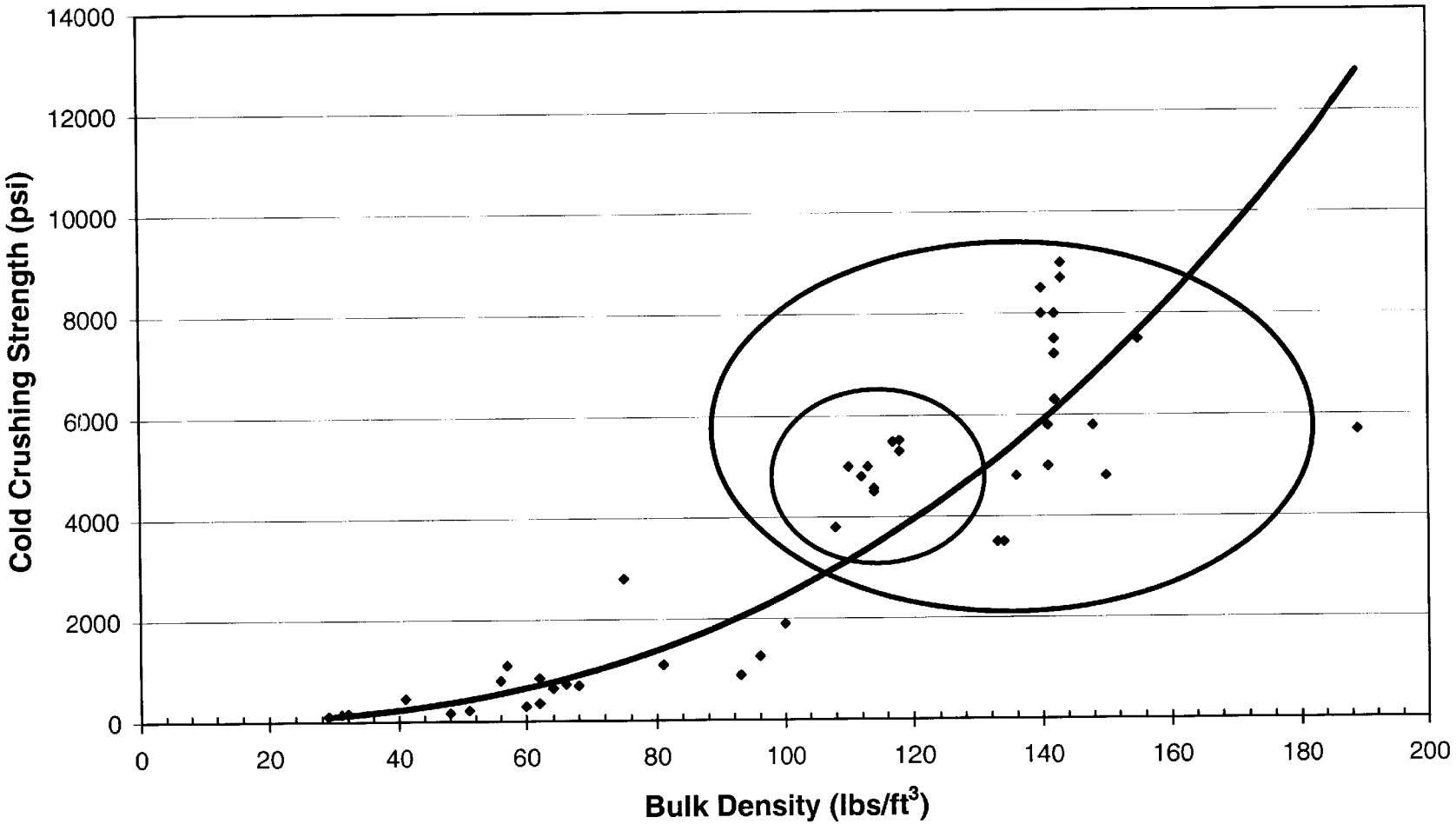
FIG. 21 is a graph of cold crushing strength versus bulk density of ceramic materials.

Ceramic materials were evaluated for suitability for use in the core of the spacer member of the present invention. FIG. 21 is a graph of cold crushing strength versus bulk density of commercially available fireclay bricks, silica bricks and insulating bricks. In general, more dense materials exhibit higher cold crushing strength. The materials having data points enclosed within the oval have adequate cold crushing strength, and the materials having data points enclosed within the circle are preferred because of their relatively low density and adequate cold crushing strength.

EXAMPLE 2

Spacer members according to the present invention were produced using an aluminum tube (AA alloy 5356) with dimensions of 3 inches×3 inches×12 (or 9) inches with a ceramic core. The weights, cold crushing strength and modulus of rupture of Samples A–I are listed in Table 1. The density of a conventional solid aluminum spacer block is about 175 lbs/ft$^3$. Cold crushing strength is a measure of static load the spacer member can withstand until failure occurs. Modulus of rupture is a measure of the bending strength of the spacer member and was determined by supporting the ends of the spacer members and applying a load until the spacer member fails. The data in Table 1 demonstrates that acceptable crushing strength and modulus of rupture can be achieved with the spacer member of the present invention when the core has a density less than the density of aluminum with concomitant weight savings. In particular, significant weight savings are achievable by using a material in the core having a maximum density of 150 lbs/ft$^3$.

TABLE 1

| Sample | Core Density (lbs/ft$^3$) | Crushing Strength (lbs/ft$^2$) | Modulus of Rupture (lbs/ft$^2$) |
|---|---|---|---|
| A | 77 | 3100 | 550 |
| B | 86 | 3000 | 700 |
| C | 96 | 7900 | 875 |
| D | 112 | 7280 | 920 |
| E | 115 | 8500 | 1600 |
| F | 132 | 9500 | 1560 |
| G | 150 | 10,450 | 1610 |
| H | 151 | 14,020 | 2235 |
| I | 165 | 21,500 | 3500 |

EXAMPLE 3

Spacer members according to the present invention were produced using an aluminum tube (AA alloy 3004) with dimensions of 2 inches×5 inches×16 inches with a ceramic core of HPV castable ceramic obtained from RHI Refractories of Pittsburgh, Pa. and a strengthening member. The type of strengthening member used in the spacer members of Samples J–M is listed in Table 2 along with the modulus of rupture therefor. Comparative Sample M did not include a strengthening member. The spacer members of Samples J–L showed significant improvement in modulus of rupture over the spacer member of Comparative Sample M without a strengthening member.

TABLE 2

| Sample | Strengthening Member | Modulus of Rupture (lbs/ft$^2$) |
|---|---|---|
| J | Type 304 stainless steel mesh sheet 0.08 inch diameter wire, 0.17 inch openings (4 mesh) | 9921 |
| K | Type 304 stainless steel mesh sheet 0.047 inch diameter wire, 0.078 inch openings (6 mesh) | 8596 |

TABLE 2-continued

| Sample | Strengthening Member | Modulus of Rupture (lbs/ft$^2$) |
|---|---|---|
| L | Expanded carbon steel flattened sheet MIL-M-17194 (¼ × #20; 0.82 lbs/ft$^2$) | 8684 |
| M (Comparative) | None | 6352 |

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. A spacer member for supporting an aluminum alloy product subjected to a heat treatment, said spacer member comprising a metal housing surrounding a ceramic core, said spacer member having a surface configured to support a portion of an aluminum alloy ingot in a furnace and a coating on said surface of said housing, said coating being configured to minimize sticking of an aluminum product to said spacer member during a heat treatment.

2. The spacer member of claim 1 wherein said metal housing comprises a metal selected from the group consisting of an aluminum alloy, steel, a nickel alloy, a cobalt alloy and a titanium alloy.

3. The spacer member of claim 1 wherein said metal housing comprises a metal tube.

4. The spacer member of claim 3 wherein said metal tube is an extruded tube.

5. The spacer member of claim 3 wherein said metal tube is a welded tube.

6. The spacer member of claim 3 further comprising a pair of end caps.

7. The spacer member of claim 6 wherein said end caps are integrally formed with said tube.

8. The spacer member of claim 6 wherein said end caps are fixed to opposing ends of said tube.

9. The spacer member of claim 1 wherein said housing comprises an aluminum alloy having a solidus temperature of over about 1180° F.

10. The spacer member of claim 9 wherein said housing comprises an Aluminum Association alloy selected from the group consisting of 7072, 3105, 3003, 1350, 1145, 1060, 1050, and 1199.

11. The spacer member of claim 1 wherein said ceramic core comprises a material selected from the group consisting of a calcium aluminate, an aluminum silicate, a magnesium silicate, silica, a high alumina cement, a low cement castable, a silica fume low-cement castable, an ultralow-cement castable, a cement-free castable, an alumina-magnesia spinel, a basic low-cement castable, a gel-bond castable and a plastic refractory.

12. The spacer member of claim 1 wherein said ceramic core has a maximum density of about 125 lbs/ft$^3$.

13. The spacer member of claim 1 wherein said ceramic core has a cold crushing strength of at least about 2000 psi.

14. The spacer member of claim 1 wherein said coating comprises a material selected from the group consisting of nickel and alloys thereof, molybdenum and alloys thereof, and boron containing compounds.

15. The spacer member of claim 1 wherein said surface has an Ra roughness of about 10 to about 10,000 micro-inches.

16. The spacer member of claim 3 wherein said metal tube has a width of up to about 3 inches.

17. The spacer member of claim 1 wherein said spacer member weighs a maximum of about 5 pounds.

18. The spacer member of claim 1 further comprising a strengthening member within said core.

19. The spacer member of claim 18 wherein said strengthening member comprises a plurality of metal fibers.

20. The spacer member of claim 18 wherein said strengthening member comprises a mesh sheet.

21. The spacer member of claim 18 wherein said strengthening member comprises a mesh tubular body.

22. A method of making a spacer member for supporting an aluminum alloy product subjected to a heat treatment, said method comprising the steps of:

a) providing a metal housing;

b) filling the metal housing with a ceramic material;

c) enclosing the ceramic material within the housing; and d) applying to an exterior surface of the metal housing a nonstick coating for preventing sticking of a heat treated aluminum product to the spacer member.

23. The method of claim 22 wherein said metal housing comprises a metal selected form the group consisting of an aluminum alloy, steel, a nickel alloy, a cobalt alloy and a titanium alloy.

24. The method of claim 22 wherein step a) comprises extruding a metal tube.

25. The method of claim 23 wherein said metal tube comprises an aluminum alloy having a solidus temperature of over about 1180° F.

26. The method of claim 22 wherein step a) comprises shaping a metal sheet into a tube shape and welding together opposite edges of the sheet to form a tube.

27. The method of claim 22 wherein step a) comprises providing a metal tube and capping one end of the tube.

28. The method of claim 27 wherein step c) comprises capping the other end of the tube.

29. The method of claim 22 wherein step b) comprises placing a curable ceramic material into the metal housing and curing the ceramic material.

30. The method of claim 29 wherein the ceramic material comprises a composition selected from the group consisting of a calcium aluminate, an aluminum silicate, a magnesium silicate, silica, a high alumina cement, a low cement castable, a silica fume low-cement castable, an ultralow-cement castable, a cement-free castable, an alumina-magnesia spinel, a basic low-cement castable, a gel-bond castable and a plastic refractory.

31. The method of claim 22 wherein the coating comprises a material selected from the group consisting of nickel and alloys thereof, molybdenum and alloys thereof, and boron containing compounds.

32. The method of claim 22 further comprising placing a strengthening member into said curable ceramic material such that the cured ceramic material fixes the strengthening member in place.

* * * * *